US006133517A

United States Patent [19]

Masubuchi

[11] Patent Number: 6,133,517

[45] **Date of Patent: *Oct. 17, 2000**

[54] KEYBOARD MUSICAL INSTRUMENT WITH SIMPLIFIED KEY UNIT ASSEMBLY

[75] Inventor: Takamichi Masubuchi, Hamamatsu, Japan

[73] Assignee: Yamaha Corporation, Hamamatsu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/982,626

[22] Filed: Dec. 2, 1997

[30] Foreign Application Priority Data

Dec. 16, 1996 [JP] Japan ..... 8-335906

[51] Int. Cl.[7] ..... G10C 3/12

[52] U.S. Cl. ..... 84/423 R; 84/433

[58] Field of Search ..... 84/423 R, 432, 84/433, 171, 174, 177, DIG. 18, 430

[56] References Cited

U.S. PATENT DOCUMENTS

| | | | |
|---|---|---|---|
| 3,722,351 | 3/1973 | Allen et al. | 84/423 R |
| 3,855,894 | 12/1974 | Thomas et al. | 84/423 R |
| 4,091,707 | 5/1978 | Martin et al. | 84/423 R |
| 4,689,442 | 8/1987 | Ozaki | 174/68.5 |
| 4,914,999 | 4/1990 | Masubuchi et al. | 84/423 R |
| 5,505,115 | 4/1996 | Vandervoort | 84/423 R |

FOREIGN PATENT DOCUMENTS

| | | |
|---|---|---|
| 2-287499 | 11/1990 | Japan . |
| 3-87899 | 4/1991 | Japan . |
| 631939 | 4/1994 | Japan . |
| 6-202617 | 7/1994 | Japan . |
| 6-250642 | 9/1994 | Japan . |
| 7092963 | 4/1995 | Japan . |
| 715019 | 4/1995 | Japan . |
| 2239548 | 7/1991 | United Kingdom . |

*Primary Examiner*—Bentsu Ro
*Assistant Examiner*—Kim Lockett
*Attorney, Agent, or Firm*—Pillsbury Madison & Sutro LLP

[57] ABSTRACT

A keyboard musical instrument has an instrument housing and a keyboard chassis integrally formed as a single piece. The keyboard musical instrument has at least one key movably supported on the keyboard chassis, a lower limit stopper for limiting the lowest descending position of the at least one key, a key switch including a movable contact and a fixed contact provided between the at least one key and the keyboard chassis, and an upper limit stopper disposed between the at least one key and the keyboard chassis for limiting an upper-most ascending position of the at least one key. The upper limit stopper is provided on a member that is independent of the keyboard chassis.

12 Claims, 6 Drawing Sheets

KEYBOARD MUSICAL INSTRUMENT WITH SIMPLIFIED KEY UNIT ASSEMBLY

BACKGROUND OF THE INVENTION

1. Field of the Invention

The present invention relates to keyboard apparatuses, such as, for example, small size and portable electronic organs, electronic keyboard apparatuses and the like.

2. Description of Related Art

A conventional electronic keyboard musical instrument typically has a case (a housing) that is made with a resin. Generally, a keyboard apparatus is independently assembled and then mounted within the case. For example, Japanese Utility Model publication HEI 7-15019 and Japanese Patent publication HEI 6-31939 describe portable type electronic keyboard musical instruments having the conventional structure. The keyboard apparatus generally includes a keyboard chassis (or a frame) that is formed from metal plates or reinforced plastic and a plurality of keys (white keys and black keys) that are movably supported over the keyboard chassis and successively arranged in a predetermined direction. The keyboard apparatus further includes a key switch, a key returning force application device, a key guide, an upper limit stopper for limiting the upper-most ascending position of the key and a lower limit stopper for limiting the lower-most ascending position provided for each of the keys.

For example, Japanese Patent Publication HEI 6-31939 describes a portable type electronic keyboard musical instrument having a keyboard chassis of a relatively complicates structure. The keyboard chassis is mounted within an instrument housing that is forme from an upper casing and a lower casing. The keyboard chassis of Japanese Patent Publication HEI 6-31939 has numerous key guide aperture sections or <lit sections that guide and stop associated keys which are movable between an initial position and a depressed position. More specifically, each of the keys has a vertically extending section that is inserted through an associated one of the key guide aperature sections. The vertically extending section includes a hook section that engages an edge section of the key guide aperture section to retain the key in a predetermined position when the key returns to its initial position. The structure of the key guide aperture sections is relatively complicated and difficult to form by a resin.

In this manner, the conventional keyboard musical instrument described above contains a relatively large number of parts, the structure of the instrument is complicated and relatively many assembling steps are required. As a result, the cost of the musical instrument is increased.

SUMMARY OF THE INVENTION

It is an object of embodiments of the present invention to provide a low cost keyboard musical instrument which is readily assembled with fewer parts.

In accordance with an embodiment of the present invention, a keyboard musical instrument has an instrument housing and a keyboard chassis integrally formed as a single piece. The keyboard musical instrument has at least one key movably supported on the keyboard chassis, a lower limit stopper for limiting the lowest descending position of the at least one key, a key switch including a movable contact and a fixed contact provided between the at least one key and the keyboard chassis, and an upper limit stopper dispose between the at least one key and the keyboard chassis for limiting an upper-most ascending position of the at least one key. The upper limit stopper is provided on a member that is independent of the keyboard chassis.

In accordance with an embodiment of the present invention, the lower stopper is mounted on the keyboard chassis. The fixed contact of the key switch is disposed on a printed substrate that is provided between the at least one key and the keyboard chassis. Also, an up er limit stopper that limits an upper-most ascending position of the key may be mounted n the printed substrate.

Alternatively, the upper limit stopper and the lower limit stopper may be mounted on a lower surface an an upper surface of the printed substrate, respectively.

As a result, a keyboard apparatus can be built directly on the instrument housing and the number of parts and assembling steps is reduced. Accordingly, keyboard musical instruments in accordance with the embodiments of the present invention are manufactured at low cost.

Furthermore, the movable contact of the key switch is provided within a dome-shaped resilient member, and the dome-shaped resilient member is disposed between the at least one key and the printed substrate so that the resilient member also functions as a key returning force application device which resiliently pushes back the associated key to its initial position as the at least one key is depressed.

Furthermore, each of the keys is formed from a key main-section, a key support section for supporting the key main section, and a coupling section that connects the key main section to the key support section in a manner so that the key main section is movable in a key depression direction. The width of the coupling section in a key width direction is greater than the width of a rear end portion of the key main section, and the coupling sections of adjacent keys partially overlap with each other. As a result, each of the keys is substantially prevented from moving in the key width direction (i.e., in the key arrangement direction). As a result, key guides or key guide apertures that are provided in the keyboard chassis in the conventional keyboard apparatus are not required.

In an embodiment of the present invention, the housing is formed from a lower case that is integrally formed with the keyboard chassis and an upper case that includes an operation panel.

As a result, in a keyboard musical instrument in accordance with the embodiments of the present invention, a keyboard apparatus is directly assembled on an instrument housing. As a result, the number of parts and assembly steps is reduced and the manufacturing cost of the keyboard musical instrument is therefore lowered.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings.

DETAILED DESCRIPTION OF EMBODIMENTS

Embodiments of the present invention will be described below with reference to the accompanying drawings FIGS. 1–5.

Figure 1:
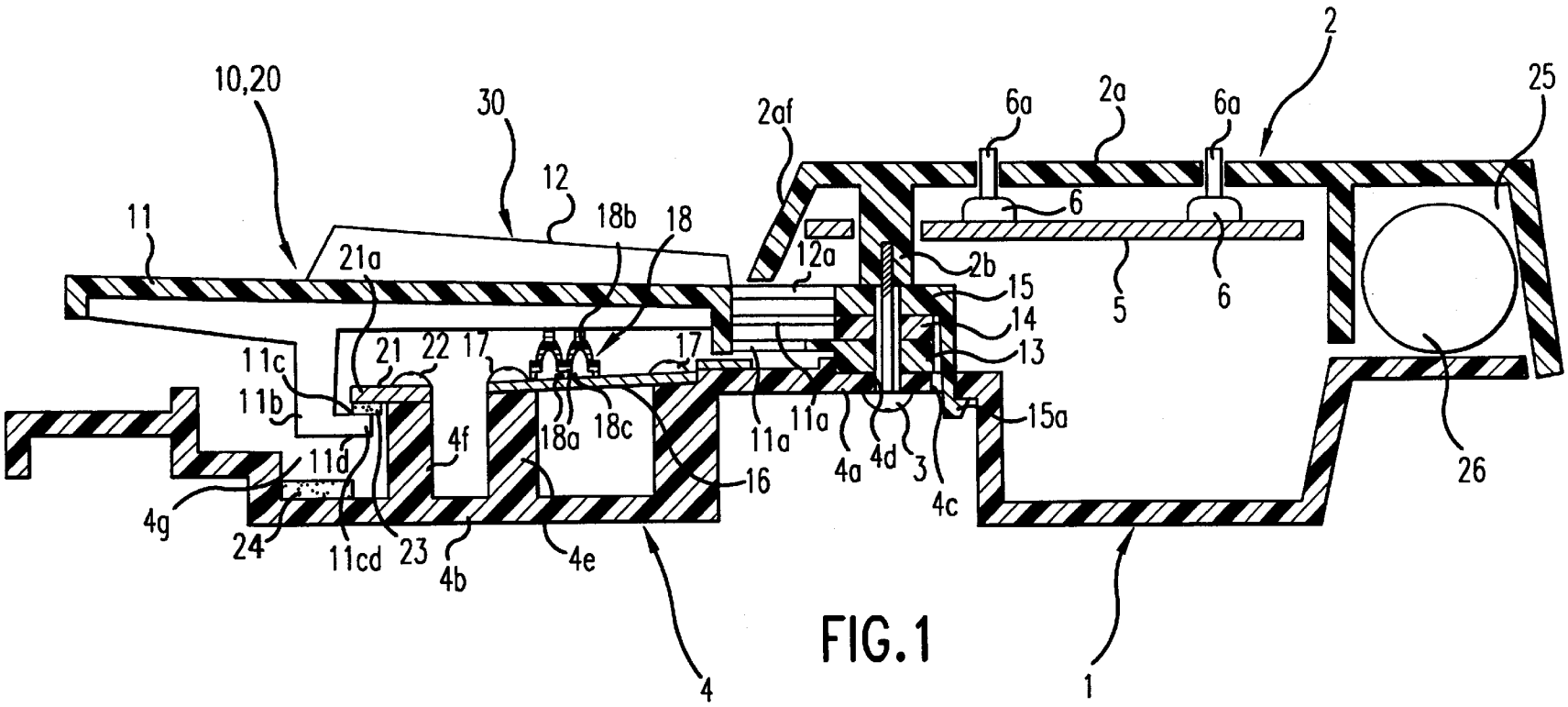
FIG. 1 shows a cross-sectional view of a keyboard musical instrument taken along the key-length direction in accordance with an embodiment of the present invention.

FIG. 1 shows a cross-sectional view of a keyboard musical instrument taken along a key length direction in accordance with an embodiment of the present invention. The keyboard musical instrument in accordance with the embodiment shown in FIG. 1 is a small size electronic keyboard musical instrument.

FIG. 1 shows a lower case 1 and an upper case 2 that are fixed together into a piece by screws 3 with key support sections (which will be described later) being sandwiched between the lower case 1 and the upper case 2. The lower case 1 and the upper case 2 are also fastened together by screws at other locations, for example, rear areas adjacent to both sides of a battery storage section 25 (that are not shown in FIG. 1). Each of the lower case 1 and the upper case 2 is integrally formed with a synthetic resin or the like. A keyboard chassis 4 is integrally formed with the lower case 1, and an operation panel 2*a* is integrated in the upper case 2. The keyboard chassis 4, the lower case 1 and the upper case 2 define an instrument housing. In other words, the instrument housing is integrally formed with the keyboard chassis 4. A control substrate is provided under the operation panel 2*a*. Many switches 6 are disposed on the control substrate 5, and operation sections 6*a* of the switches 6 protrude above the operation panel 2*a*.

Figure 2:
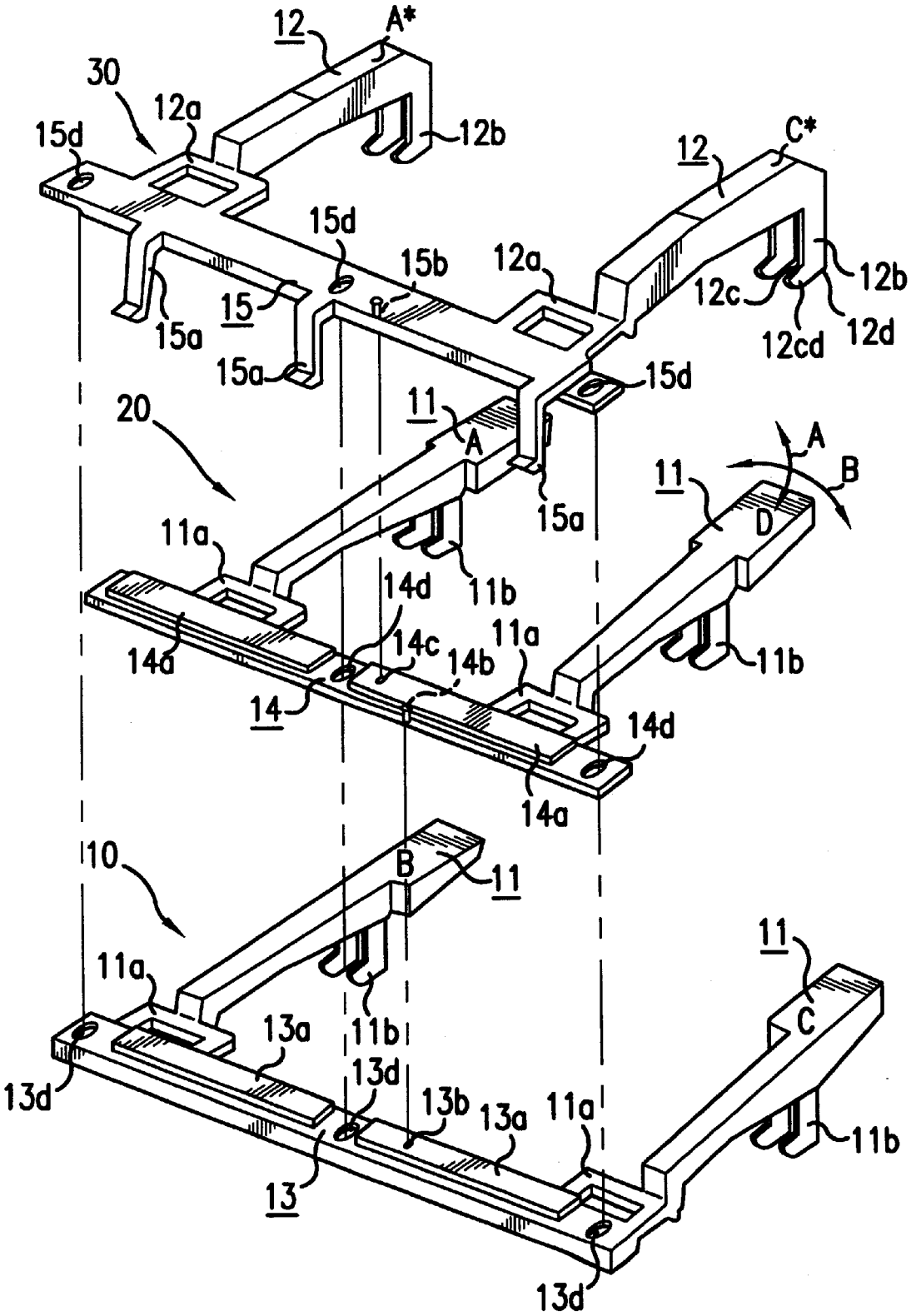
FIG. 2 shows a perspective, exploded view of key units for one octave to be used for the keyboard musical instrument shown in FIG. 1.

Three types of key units (white key units 10 and 20 and a black key unit 30) are connected together and arranged on the keyboard chassis 4. As shown in FIG. 2, each of the white key units 10 and 20 has a plurality of white keys 11 and the black key unit 30 has a plurality of black keys 12.

Each of the white keys 11 of the white key units 10 and 20 includes an integrally formed thin coupling section 11*a* that is connected to integrally formed key support sections 13 and 14, respectively, and each of the black keys 12 includes an integrally formed thin coupling section 12*a* that is connected to an integrally formed key support section 15. The thin coupling sections 11*a* and 12*a* are flexible so that the keys 11 and 12 flexibly move in a key depression direction (for example as shown by an arrow A) about the respective thin coupling sections 11*a* and 12*a* upon depression of the keys 11 and 12.

The key support sections 13, 14 and 15 are stacked one on top of the other. The key support sections 13, 14 and 15 are then cramped between a stepped-up section 4*a* of the keyboard chassis 4 and a boss section 2*b* of the upper case 2 and fixed to the instrument housing by the screws 3.

FIG. 2 shows a perspective view of the structure of the key units 10, 20 and 30 for one octave in accordance with an embodiment of the present invention.

The white key unit 10 includes four white keys 11, i.e., C-key, E-key, G-key and B-key (E-key and G-key are omitted and not shown for simplicity). Each of the white keys 11 is connected through the thin coupling section 11*a* to the elongated key support section 13 that extends in a key arrangement direction in which the keys 11 and 12 are arranged side by side.

In the similar manner, the white key unit 20 includes three white keys 11, i.e., D-key, F-key and A-key (F-key is omitted and not shown for simplicity). Each of the white keys 11 is connected through the thin coupling section 11*a* to the elongated key support section 14 that extends in the key arrangement direction.

The black key unit 30 includes five black keys 11, i.e., C#-key, D#-key, F#-key, G#-key and A#-key 12 (only C#-key and A#-key are shown for simplicity). Each of the black keys 12 is connected through the thin coupling section 12*a* to the elongated key support section 15 that extends in the key arrangement direction.

Each of the keys 11 and 12 includes a key stopper section 11 b and a key stopper section 12*b*, respectively, that is defined by a downwardly extending bent section having an L-shaped tip section (stopper section) 11*cd*. Also, the black key unit 30 has a plurality of downwardly extending hooks 15*a* in the rear section of the key support section 15 that are used to temporarily fix the key units 10, 20 and 30 to the keyboard chassis 4.

All the component sections of each of the white key units 10 and 20 and the black key unit 30 are integrally formed with a resin. For example, the white key 11, the coupling sections 11*a*, the stopper sections 11*cd* and the key support section 13 for the white key unit 10 are integrally formed into a single piece with a resin.

Figure 3:
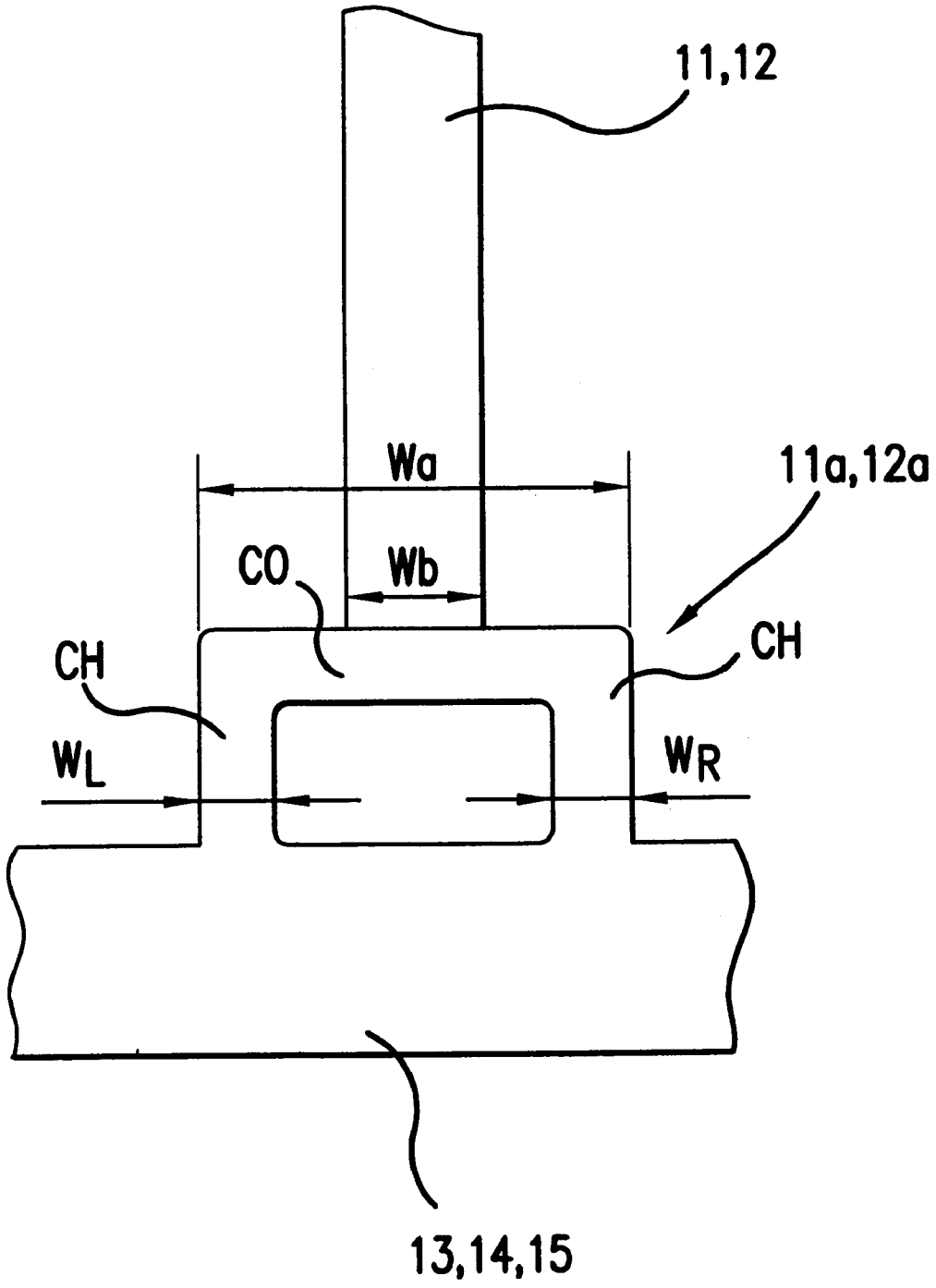
FIG. 3 shows the rear section of a key main section and a coupling section of a key in the key unit shown in FIG. 2.

As shown in FIG. 3, each of the coupling sections 11*a* and 12*a* of each of the keys 11 and 12 includes connecting sections CH and a joint section CO. The entire width Wa of each of the coupling sections 11*a* and 12*a* in the key width direction is about three times as wide as the key width Wb of the rear section of the key main section. However, the sum of the width WR and the width WL of the connecting sections CH is generally the same as the key width Wb of the rear section of the key main section.

As a result, movement of each of the keys 11 and 12 in the key width direction (the key arrangement direction) shown by an arrow B in FIG. 2 about the respective coupling sections 11*a* and 12*a* is substantially prevented, while movement of each of the keys 11 and 12 in the key depression direction shown by an arrow A in FIG. 2 is not hampered. As a consequence, the requirement of key guides or key guide apertures in the keyboard chassis is eliminated.

The above-described key guide apertures have been conventionally indispensable as described in Japanese Patent Publication HEI 6-31939 and Japanese Utility Model Publication HEI 7-15019 described above. This is because sections must be provided on the housing or the chassis to abut and stop the stopper sections 11*cd* of the keys 11 and 12 shown in FIG. 1 when the keys 11 and 12 are not depressed, and such a section is typically provided in the form of a guide aperture (or an aperture section) in the conventional keyboard apparatus. In accordance with the embodiment of the present invention, a key guide (which typically includes sections vertically extending from the chassis to guide the movement of an associated key in the vertical direction) is not required in the keyboard chassis, and only an abutting section is required for the stopper section 11*cd*. In the present embodiment, the abutting section is provided by a hard member 21 that is a plate member having a simple structure. Accordingly, the key guide aperture is not required since the key guide aperture is replaced by the hard member 21.

As shown in FIG. 2, a plurality of protruded sections 13*a* and 14*a* are formed on the top surface of each of the key support sections 13 and 14 of the white key units 10 and 20. Recessed sections (not shown) to be mated with the protruded sections 13*a* and 14*a* are formed in the lower surfaces of the key support sections 14 and 15 of the white key unit 20 and the black key unit 30 which are disposed on the white key units 10 and 20, respectively.

The key support section 14 of the white key unit 20 is disposed on the key support section 13 of the white key unit 10. A positioning pin 14*b* that protrudes on the under surface of the key support section 14 is inserted in a positioning aperture 13*b* formed in the key support section 13 for alignment and engagement between the protruded sections 13*a* and the associated recesses. Further, a positioning pin 15*b* protruding on the key support section 15 of the black key unit 30 is inserted in a positioning aperture 14*c* formed in the key support section 14, and the key support section 15 is disposed on the key support section 14.

Then, as shown in FIG. 1, the hooks 15*a* of the key support section 15 of the black key unit 30 are inserted in retaining apertures 4*c* that are defined in the stepped-up section 4*a* of the keyboard chassis 4. As a result, the key units 10, 20 and 30 are temporarily retained on the stepped-up section 4*a*. Then, the screws 3 shown in FIG. 1 are passed through mounting apertures 4*d* defined in the keyboard chassis 4 and mounting apertures 13*d*, 14*d* and 15*d* defined in the key support sections 13, 14 and 15, respectively, and screwed -in the boss section 2*b* of the upper case 2. The screws 3 are passed from the bottom through the key chassis 4 and the key units 10, 20 and 30, and screwed to the upper case 2 at about three different locations, for example, adjacent to the right-most end, the left-most end and the center of the group of the key units. In this manner, the key units 10, 20 and 30 are fixed to the keyboard chassis 4.

Alternatively, a group of the key units 10, 20 and 30 may be fixed to the chassis 4 in a different manner. For example, screws may be passed from of the top-most key unit 30 the top most key unit 30 and through the remaining key units 20 and 10 and screwed to the keyboard chassis 4.

Plural sets of the key units 10, 20 and 30 are arranged in the key arrangement direction and connected together for a required range of keys to form a keyboard apparatus.

The keyboard chassis 4 shown in FIG. 1 has a stepped-down section 4*b*. Two rows of support sections 4*e* and 4*f* in the form of ribs protruding from the stepped-down section 4*b* extend in the key arrangement direction (in a direction perpendicular to the surface of the drawing). All the key stopper sections 11*b* and 12*b* of the white keys 11 and the black keys 12 are received in an open area 4*g* that extends along the support section 4*f*. The open area 4*g* is a recessed area formed in the keyboard chassis 4 or an opening section formed in the keyboard chassis 4. Since the coupling sections 11*a* and 12*a* of the white keys 11 and the black keys 12 allows movement of the white keys 11 and the black keys 12 in the key depression direction and substantially prevent the white keys 11 and the black keys 12 from moving in the key arrangement direction, key guides are not required in the open area 4*g* to guide vertical movement of the key stopper sections 11*b* and 12*b*.

An elongated printed substrate 16 extending in the key arrangement direction and made from an insulating hard material is disposed across the support section 4*e* and the stepped-up section 4*a* and affixed by screws 17 to the keyboard chassis 4. As a result, the printed substrate 16 is disposed between the keys 11 and 12 and the stepped-down section 4*b* of the keyboard chassis 4.

Figure 6:
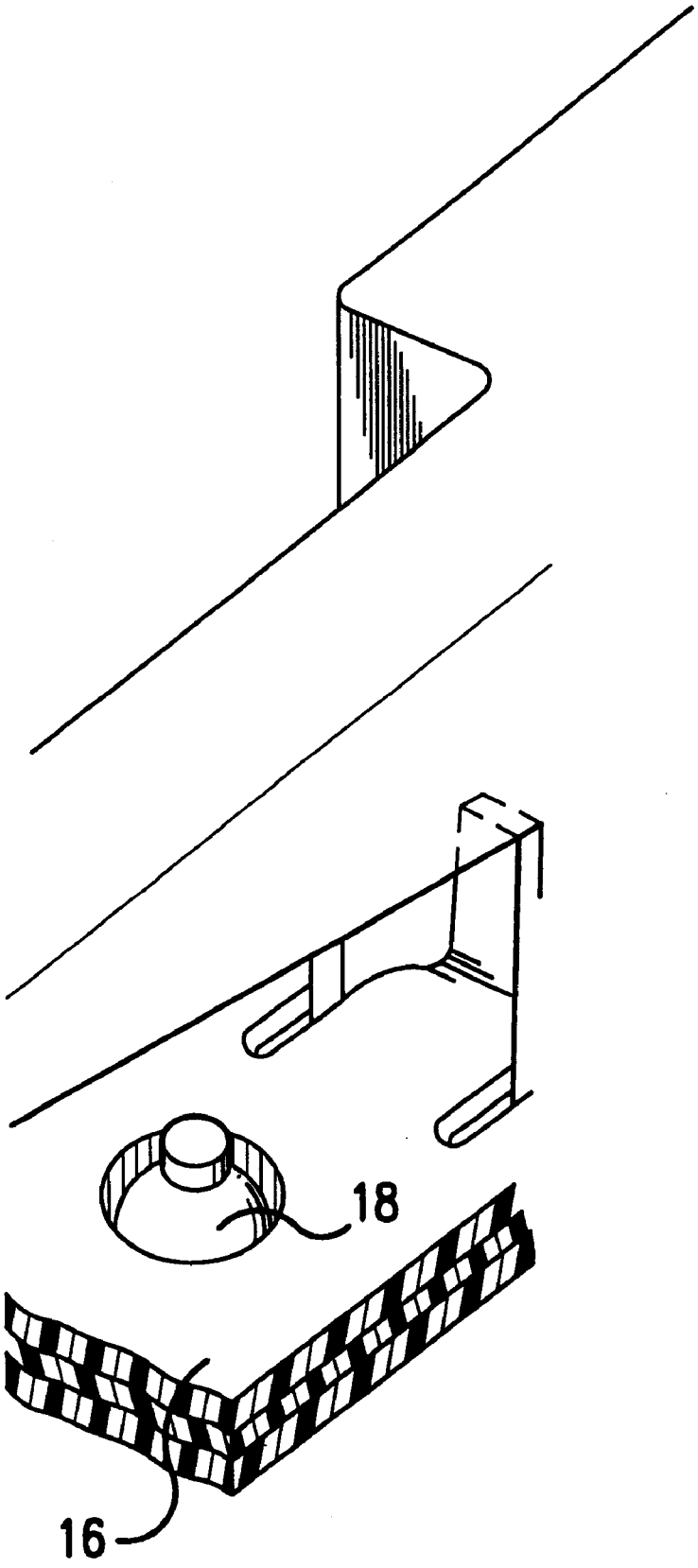
FIG. 6 shows a perspective view of a key switch in accordance with an embodiment of the present invention.

Key switches 18 (see also FIG. 6) are provided between the associated keys 11 and 12 and the printed substrate 16. Each of the key switches 18 is formed from a pair of fixed contacts 18*a* that are formed by conductive patterns printed on the printed substrate (switch substrate) 16, a dome-shaped flexible member 18*b* disposed over the fixed contacts 18*a*, and a movable contact 18*c* to be paired with the fixed contacts 18*a* that is formed on the lower central surface of the flexible member 18*b*.

The dome-shaped member 18*b* is made of silicone rubber or the like. The upper surface of the dome-shaped member 18*b* is normally in contact with the lower surface of each of the keys 11 and 12 and applies a returning force acting upwardly on each of the keys 11 and 12. When any one of the keys 11 and 12 is depressed downwardly, the corresponding dome-shaped flexible member 18*b* is depressed and resiliently deformed so that the movable contact 18*c* is brought into contact with the associated fixed contacts 18*a* to turn on the switch. As a result, a key-on signal is generated and inputted to a musical sound signal generation circuit (not shown) that generates a musical sound signal for a pitch corresponding to the depressed key.

In another embodiment, a circular second contact may be provided outside of the fixed contacts 18*a* on a concentric circle to form a touch-response switch.

A hard plate member 21 is attached to the top of the support section 4*f* of the keyboard chassis 4 by screws 22. The hard plate member 21 includes a front section 21*a* that protrudes into the open space 4*g*. A horizontally extending upper edge 11*c* or 12*c* (see FIG. 2) of the bent section 11*cd* or 12*cd* of each of the stopper members 11*b* and 12*b* of each of the keys 11 and 12 abuts the lower surface of the front section 21*a* of the hard plate member 21. In a preferred embodiment, an upper stopper 23 is attached to the lower surface of the front section 21*a* of the hard plate member 21 for limiting an upper-most ascending position of each of the keys 11 and 12. The upper stoppers 23 are made of a damping material, such as, for example, felt, rubber and the like, and disposed for all of the keys in a belt-like formation extending in the key arrangement direction.

The hard member 21 is separated from and independent of the switch substrate 16 because an upper stopper section defined by the hard member 21 can be more readily provided with a stronger structure. For example, if the hard member 21 is made from the same epoxy resin that is used for the switch substrate 16, the hard member 21 can readily be made thicker to increase the structural strength of the upper stopper section. On the other hand, if the hard member 21 and the switch substrate 16 are formed in a single piece, it is difficult to provide a thicker portion at an area corresponding to the hard member 21. Since the structural strength of the upper stopper section is increased by increasing the thickness of the hard member 21, the keyboard musical instrument withstands the wrong handling of the musical instrument by a user, such as, for example, completely lifting the musical instrument by holding only the free ends of the keys.

Furthermore, a low cost pre-touch musical instrument control can be readily designed to improve the capability of musical expression. In other words, instead of the hard member 21, a pre-touch sensor (that may be independently provided for each of the keys or commonly provided for all of the keys) is disposed on the support section 4*f*. The pre-touch sensor is formed from conductive patterns, a substrate that is made from a mixture of carbon and semi-conducting powder and a conducting rubber member that function as the upper stopper 23. Since the resistance of the sensor becomes large in an initial stage of key depression, a performance method can be detected and therefore a pre-touch musical tone control can be performed.

When the hard member 21 is independent of and separated from the key switch substrate 16, the per-lot rejection rate is lowered when the above-described pre-touch function is added, and therefore the manufacturing cost is lowered.

Also, the pre-touch function may be added to a single piece unit in which the upper stopper and the switch substrate 16 are formed into one piece (see FIGS. 4 and 5), which will be described later in detail. In this case, if a method to lower the above-described per-lot rejection rate is established, the single piece unit can be manufactured at low cost because assembly is simpler.

A lower stopper 24 is disposed on the upper surface of the stepped-down section 4*b* of the keyboard chassis 4, at a place opposing each of the stopper sections 11*b* and 12*b* of each of the keys 11 and 12. The lower stopper 24 limits a lower-most descending position of each of the keys 11 and 12. The lower stoppers 24 are also formed from a damping material, such as, felt, rubber and the like, and disposed for all of the keys in a belt-like configuration that extends in the key arrangement direction. When any one of the keys 11 or 12 is depressed, a lower edge 11*d* or 12*d* (see FIG. 2) of the corresponding stopper section 11*b* or 12*b* (see FIG. 2) of the key 11 or 12 abuts the lower stopper 24 to limit a lower-most ascending position of the key 11 or 12.

A battery storage chamber 25 is provided at a rear section of the instrument housing that is formed by the lower case 1 and the upper case 2. A plurality of batteries 26, which are a power source for the musical instrument, are stored in the battery storage chamber 25.

A front end section 2*af* of the upper case 2 covers areas in the rear of the coupling sections 11*a* and 12*a* of the keys 11 and 12 to provide a pleasing appearance.

In the keyboard musical instrument shown in FIG. 1, a keyboard apparatus can be built directly on an instrument housing, key guides are not required, and the number of parts and assembly steps is reduced. As a result, the manufacturing cost of the keyboard musical instrument is lowered.

Also, the movable contact 18*c* of the key switch 18 is provided within the dome-shaped flexible member 18*b*, and the dome-shaped flexible member 18*b* is disposed between each of the keys 11 and 12 and the printed substrate 16. As a result, the dome-shaped flexible member 18*b* applies a returning force to each of the keys 11 and 12. Consequently, a returning force application device, such as, for example, a key return spring is not required.

A keyboard musical instrument in accordance with a second embodiment of the present invention will be described with reference to FIG. 4.

Figure 4:
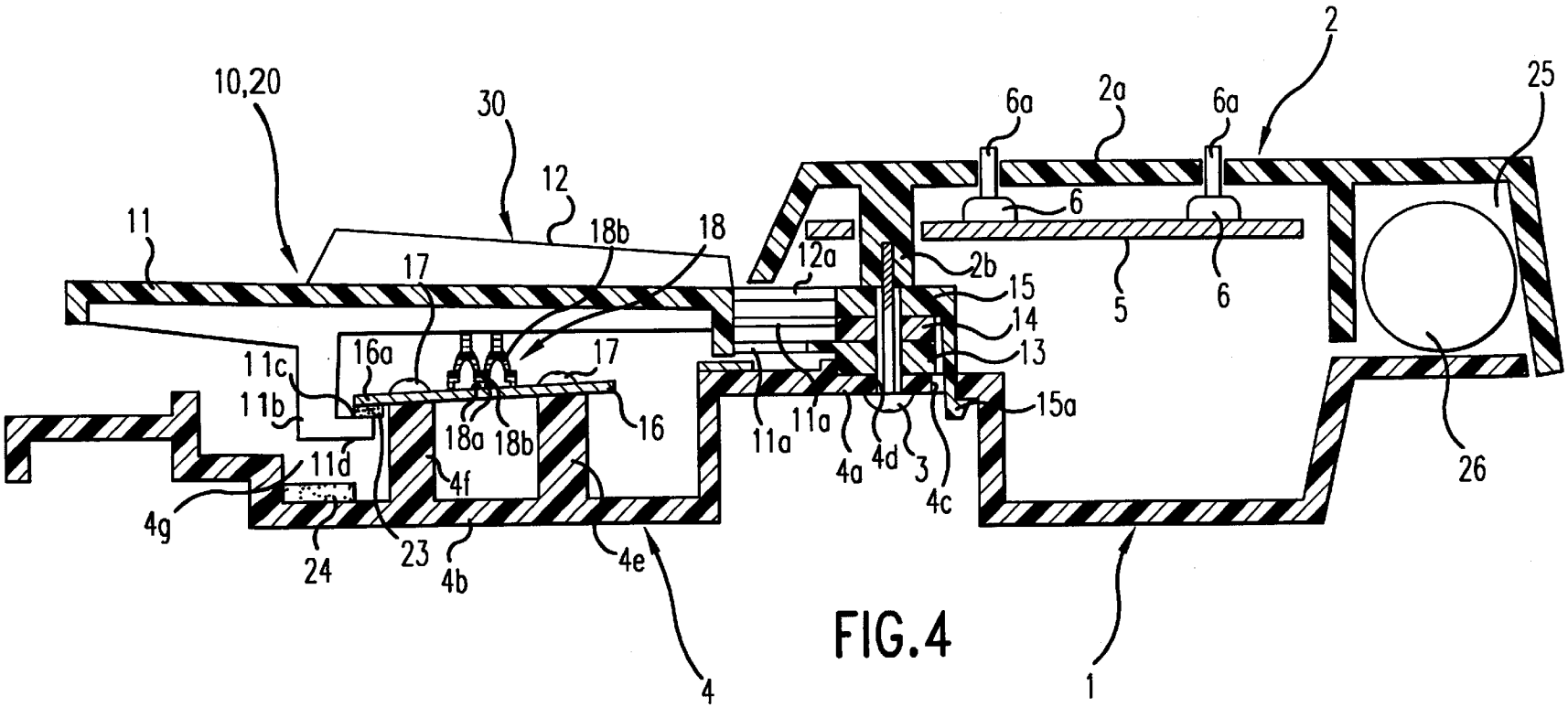
FIG. 4 shows a cross-sectional view of a keyboard musical instrument taken along the key-length direction in accordance with another embodiment of the present invention.

FIG. 4 shows a cross-sectional view of a keyboard musical instrument in accordance with the second embodiment of the present invention, which is similar to FIG. 1. It is noted that the same reference numerals are used for parts similar to the corresponding parts shown in FIG. 1, and the description for these parts is omitted.

The keyboard musical instrument in the second embodiment is different from the keyboard musical instrument shown in FIG. 1 only in that the hard member 21 of FIG. 1 is not provided, and instead, an upper limit stopper 23 is provided on the under surface adjacent to a front leading end 16*a* of a printed substrate 16 that supports key switches 18.

In order to implement the above-described structure, two support sections 4*e* and 4*f* disposed on the upper surface of a stepped-down section 4*b* of a keyboard chassis 4 are more widely separated in, the key-length direction than those shown in FIG. 1. Furthermore, the printed substrate 16, that is formed from a hard material, is attached to the top of the support sections 4*e* and 4*f* by screws 17. The key switches 18, which are of the same type as those shown in the above-described embodiment, are disposed between the printed substrate 16 and the associated keys 11 and 12. In a preferred embodiment, the leading end 16*a* of the printed substrate 16 protrudes into the open space 4*g* and the upper limit stopper 23 is disposed on the underside surface adjacent to the leading end 16*a* of the printed substrate 16. As a result, the number of parts and assembly steps is further reduced.

Figure 5:
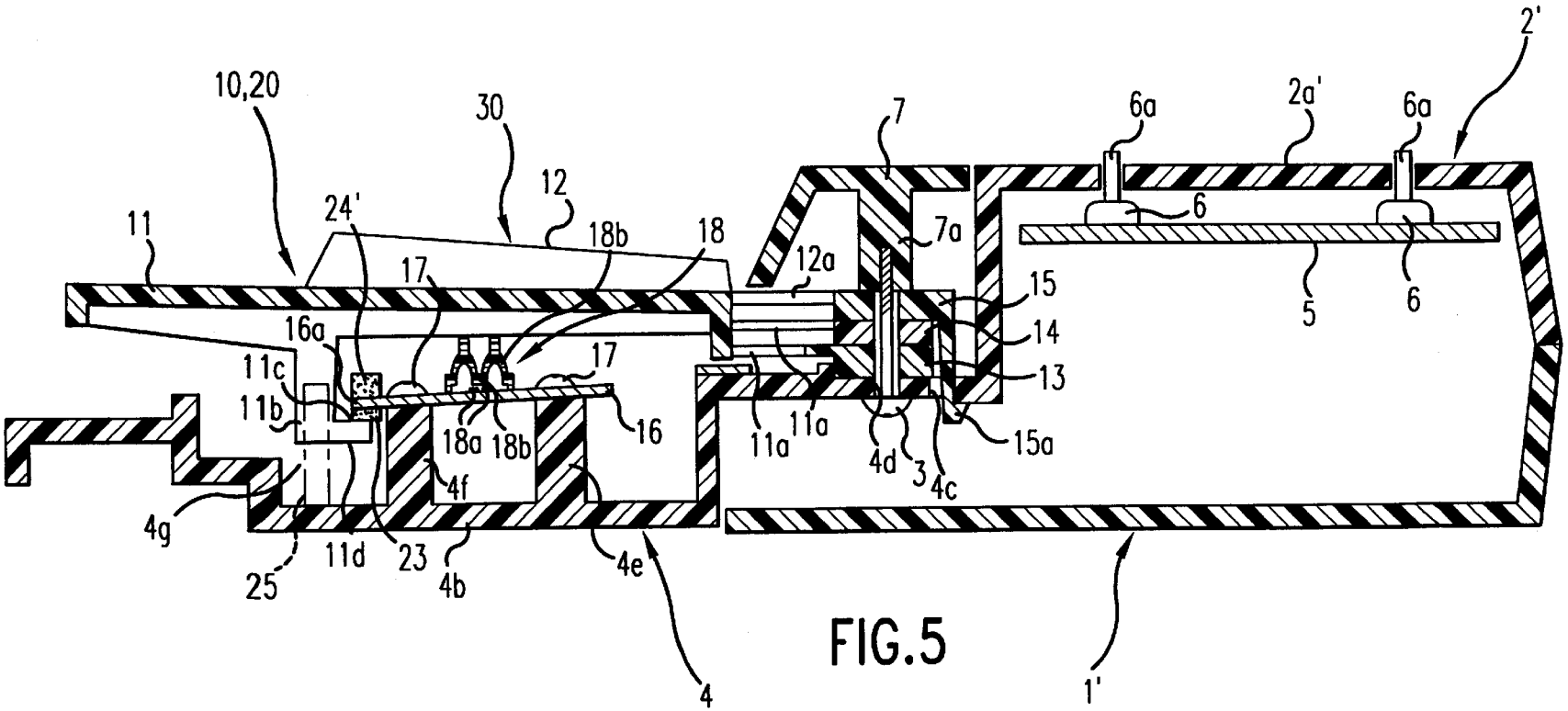
FIG. 5 shows a cross-sectional view of a keyboard musical instrument taken along the key length direction in accordance with still another embodiment of the present invention.

A keyboard musical instrument in accordance with a third embodiment of the present invention will be described with reference to FIG. 5. FIG. 5 shows a cross-sectional view of a keyboard musical instrument, which is similar to those shown in FIGS. 1 and 2. It is noted that the same reference numerals are used for parts similar to the corresponding parts shown in FIGS. 1 and 2, and the description for these parts is omitted.

In keyboard musical instrument in accordance with the third embodiment, a keyboard chassis 4 and an upper case 2' that has a control panel 2*a'* are formed into a piece. A cover member 7, that is independent of the upper case 2', is provided to cover areas in the rear of coupling sections 11*a* and 12*a* of the keys 11 and 12. Screws 3 are screwed in a boss section 7*a* of the cover member 7 to fix the key support sections 13, 14 and 15 of the key units 10, 20 and 30 to the keyboard chassis 4.

Upper limit stoppers for the keys 11 and 12 are provided on the lower surface and adjacent to the front leading end 16*a* of a printed substrate 16, in the same manner as the above-described second embodiment shown in FIG. 4. Furthermore, a lower limit stopper 24', that abuts the lower surface of each of the keys 11 and 12 is provided on the upper surface and adjacent to the front leading end of the printed substrate 16 for limiting a lower-most descending position of each of the keys 11 and 12.

A lower case 1', that is formed independently of the keyboard chassis 4, is attached, by a device not shown, to the upper case 2' and the keyboard chassis 4 to form a one-piece instrument housing. A battery storage chamber (not shown) is provided at a position different than the above-described embodiments.

The keyboard musical instrument in accordance with the-third embodiment provides the same effects as those provided by the keyboard musical instrument in accordance with the second embodiment shown in FIG. 4.

In each of the above-described embodiments, the entire width of the coupling section (fulcrum section) of each of the keys is wider than the width of the rear section of the key main section of each of the key. As a result, movements of the keys in the key width direction are reduced, and key guides and guide apertures in a keyboard chassis are not required.

The present invention is not limited to the keyboard apparatuses described above. For example, as shown in FIG. 5 by a phantom line, a key guide 25 that is inserted within each of the stopper sections 11*b* and 12*b* of each of the keys 11 and 12 may be provided. Furthermore, guide apertures (not shown) that guide the stopper sections 11*b* and 12*b* of the keys 11 and 12 may be formed in the keyboard chassis 4.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A keyboard musical instrument comprising:

an instrument housing having a keyboard chassis, a lower case, and an upper case;

at least one key movably supported on the keyboard chassis;

an opening section formed in the keyboard chassis and defining a single opening for receiving a key stopper engaging section of the at least one key;

a lower limit stopper mounted on the keyboard chassis for limiting a lower-most descending position of the at least one key by abutting and engaging the key;

a key switch provided between the at least one key and the keyboard chassis;

a printed substrate having an upper surface and a lower surface and provided between the at least one key and the keyboard chassis for supporting the key switch, wherein a projecting end of the printed substrate protrudes into the opening section; and an upper limit stopper disposed on the lower surface of the projecting end of the printed substrate for limiting an upper-most ascending position of the at least one key by abutting and engaging the key, wherein the upper limit stopper and the printed substrate are multiple parts integrally formed as a unit.

2. A keyboard musical instrument comprising:

an instrument housing having a keyboard chassis, a lower case, and an upper case;

a key movably supported on the keyboard chassis;

an opening section formed in the keyboard chassis and defining a single opening for receiving a key stopper engaging section of the key;

a key switch provided between the key and the keyboard chassis;

a printed substrate having an upper surface and a lower surface and provided between the key and the keyboard chassis for supporting the key switch, wherein a projecting end of the printed substrate protrudes into the opening section; and an upper limit stopper and a lower limit stopper respectively disposed on the lower surface and the upper surface of the projecting end of the printed substrate for limiting an upper-most ascending position and a lower-most descending position of the key, respectively, by abutting and engaging the key, wherein the upper limit stopper, the lower limit stopper, and the printed substrate are multiple parts integrally formed as a unit.

3. A keyboard musical instrument comprising:

an instrument housing including an integrally formed keyboard chassis section defining a key arrangement direction;

a key unit fixed to the keyboard chassis section and having a plurality of keys, each of the plurality of keys defining a key length direction transverse to the key arrangement direction and having a key stopper engaging section;

an opening section formed in the keyboard chassis section and defining a single opening for receiving a plurality of the key stopper engaging sections of the plurality of keys;

a printed substrate provided between the plurality of keys and the keyboard chassis section and having a front leading end which protrudes into the single opening; and a plurality of key switches disposed on the printed substrate for the associated plurality of keys, wherein the front leading end of the printed substrate abuts and engages the key stopper engaging sections of the plurality of keys so as to limit at least one of an upper-most ascending position and a lower-most descending position of each of the plurality of the keys.

4. A keyboard musical instrument according to claim 3, wherein the key unit is formed from an integrally formed piece including the plurality of keys, a corresponding plurality of flexible coupling sections connecting to the respective plurality of keys and a key support section connecting to the coupling sections.

5. A keyboard musical instrument according to claim 4, wherein each of the plurality of keys defines a key width in the key arrangement direction and the two spaced members are spaced a distance greater than the key width of the associated key to allow the associated key to move in a key depression direction about the coupling section and substantially prevent the associated key from moving in the key arrangement direction.

6. A keyboard musical instrument according to claim 5, wherein each of the plurality of keys defines a non-depressed position, and wherein the flexible member is normally in contact with the associated key and applies a key returning force to the associated key to return to the non-depressed position when the associated key is depressed.

7. A keyboard musical instrument according to claim 6, further comprising a lower limit stopper disposed on the keyboard chassis section for limiting a lower-most descending position of each of the associated plurality of keys, a stopper member independent of the printed substrate and attached to the keyboard chassis section adjacent to the opening section, and an upper limit stopper attached to the stopper member for limiting an upper-most ascending position of each of the associated plurality of keys.

8. A keyboard musical instrument according to claim 7, further comprising an elongated rib section formed in the keyboard chassis section and extending in the key arrangement direction adjacent to the opening section, wherein the stopper engaging section of each of the plurality of keys includes a downwardly extending member having a lower end and a horizontally extending section connecting to the lower end, and the stopper member is attached to a top of the rib section for engagement with the horizontally extending section of the stopper engaging section.

9. A keyboard musical instrument according to claim 6, further comprising a lower limit stopper disposed on the keyboard chassis section for limiting a lower-most descending position of each of the associated plurality of keys, and an upper limit stopper disposed on the printed substrate adjacent to the opening section for limiting an upper-most ascending position of each of the associated plurality of keys.

10. A keyboard musical instrument according to claim 9, further comprising an elongated rib section formed in the keyboard chassis section and-extending in the key arrangement direction adjacent to the opening section, wherein the stopper engaging section of each of the plurality of keys includes a downwardly extending member having a lower end and a horizontally extending section connecting to the lower end, and the printed substrate is attached to a top of the rib section and has an end section extending into the opening section, the upper limit stopper is attached to the end section of the printed substrate for engagement with the horizontally extending section of the stopper engaging section.

11. A keyboard musical instrument according to claim 6, wherein the printed substrate defines an upper surface opposing the plurality of keys and a lower surface opposing the keyboard chassis, and further comprising a lower limit stopper disposed on the upper surface of the printed substrate for limiting a lower-most descending position of each of the associated plurality of keys, and an upper limit stopper disposed on the lower surface of the printed substrate adjacent to the opening section for limiting an upper-most ascending position of each of the associated plurality of keys.

12. A keyboard musical instrument according to claim 11, further comprising an elongated rib section formed in the keyboard chassis section and extending in the key arrangement direction adjacent to the opening section, wherein the stopper engaging section of each of the keys includes a downwardly extending member having a lower end and a horizontally extending section connecting to the lower end, and the printed substrate is attached to a top of the rib section and has an end section extending into the opening section, the upper limit stopper is attached to the end section of the printed substrate for engagement with the horizontally extending section of the stopper engaging section.

* * * * *